US006804983B2

(12) United States Patent
Mori et al.

(10) Patent No.: US 6,804,983 B2
(45) Date of Patent: Oct. 19, 2004

(54) DIE CUSHION APPARATUS

(75) Inventors: Yoshio Mori, Yokohama (JP); Shinkichi Nagami, Shinagawa-ku (JP)

(73) Assignee: Ishikawajima-Harima Heavy Industries, Co., Ltd., Tokyo (JP)

( * ) Notice: Subject to any disclaimer, the term of this patent is extended or adjusted under 35 U.S.C. 154(b) by 0 days.

(21) Appl. No.: 10/179,223

(22) Filed: Jun. 26, 2002

(65) Prior Publication Data

US 2003/0000277 A1 Jan. 2, 2003

(30) Foreign Application Priority Data

Jul. 2, 2001 (JP) ..... 2001-200294

(51) Int. Cl.[7] ..... B21D 24/02
(52) U.S. Cl. ..... 72/350; 72/453.13
(58) Field of Search ..... 72/350, 351, 453.13, 72/21.2; 267/119

(56) References Cited

U.S. PATENT DOCUMENTS 2,584,339 A * 2/1952 Georgeff ..... 267/119
3,162,159 A 12/1964 Krauss et al.
5,339,665 A * 8/1994 Yoshikawa ..... 72/20.1

FOREIGN PATENT DOCUMENTS

| | | | |
|---|---|---|---|
| CH | 1375865 A | * | 2/1988 |
| EP | 0 556 390 A1 | | 8/1993 |
| JP | 63-273524 | | 11/1988 |

* cited by examiner

*Primary Examiner*—Allen Ostrager
*Assistant Examiner*—Jimmy Nguyen
(74) *Attorney, Agent, or Firm*—Griffin & Szipl, P.C.

(57) ABSTRACT

A gas cushion apparatus with a support member to hold a blank, gas pressure cylinders that push the support member upwards, a hydraulic cylinder whose upper rod is connected to the support member, a pneumo-hydraulic converter for secondary lifting with a piston that partitions the interior into an oil chamber communicating with the oil chamber on the side of the rod of the hydraulic cylinder and a gas chamber, a check valve that allows oil to flow from the oil chamber on the side opposite to the above-mentioned rod to the oil chamber on the side of the aforementioned rod, and a drain port communicating with the oil chamber on the side of the above-mentioned rod of the hydraulic cylinder.

22 Claims, 6 Drawing Sheets

DIE CUSHION APPARATUS

BACKGROUND OF THE INVENTION

1. Technical Field of the Invention

The present invention relates to a die cushion apparatus for a press machine. In particular, the invention relates to a feature in the operating mechanism of a die cushion apparatus.

2. Description of the Related Art

Conventionally, with a single-acting press, when a cylindrical container, for instance, is pressed, the blank is prevented from being wrinkled at the periphery thereof. That is, the press is provided with a die, and a punch is arranged in the lower mold. The punch is fixed to the bolster. A blank holder is provided outside the punch to support the periphery of the blank. This blank holder is supported by cushion pins attached to a die cushion apparatus.

The lower structure of a conventional press machine is described referring to drawings. FIG. 1 is a sectional side view of the lower structure of a press machine incorporating a conventional die cushion apparatus.

The lower structure 1 of the press machine is provided with a die cushion apparatus 300, a blank holder 10, a die 20, a punch 30, a bolster 40, a press bed 50 and a slide 60.

The press bed 50 is the lower structure of the press frame, and is connected to the upper structure by means of an upright member, and supports the weight of the whole press. The bolster 40, the lower surface of which is resting on the press bed 50 is a base that supports the punch 30. The punch 30 is a lower die, the lower surface of which is supported by the bolster 40. The die 20 is an upper mold, the upper surface of which is attached to a slide 60. The slide 60 holds the die 20, is supported on the press frame in a manner such that it is free to move up and down, and is driven up and down by a drive mechanism. The blank holder 10 is a device that sandwiches the periphery of the blank between the upper surface 11 of the blank holder 10 and the lower surface 21 of the die 20 when the machine presses the blank between the die 20 and the punch 30. The blank holder 10 is also a device that supports the blank after the pressing process is finished and transfers it to an unloading device, and the lower surface of the holder is supported by the die cushion apparatus 300. The die cushion apparatus 300 is a device for supporting the blank holder 10, and is attached to the press bed 50.

Here, the functions that the die cushion apparatus 300 must provide are described. The primary function is the requirement to reduce the noise and vibration produced by the die 20 and the punch 30 during the pressing process (this is called the cushion function). In addition, another function of the apparatus is to clamp the outer periphery of the blank between the lower surface 21 of the die 20 and the upper surface 11 of the blank holder 20 to prevent the outer periphery of the blank from being creased when the die 20 presses the blank (this is called the crease-pressing function). Also, to protect the outer periphery of the blank from being damaged when the die 20 passes bottom dead center and starts to rise, the blank holder 10 that supports the blank is locked so that it does not travel past the bottom dead center position (this is called the locking function). Furthermore, this locking function is preferably also capable of lowering the blank holder 10 with the blank resting on it from the bottom dead center position by a predetermined distance (for example, about 3 mm). Moreover, when the die 20 passes bottom dead center and travels to the top dead center, the blank must be quickly transferred to an unloading device. For this purpose, another function is required that is to lift the blank holder 10 that supports the blank by a predetermined distance (for example, about 35 mm) and then stop the holder (this is called the secondary lifting function).

Next, the construction of a conventional die cushion apparatus is described. The die cushion apparatus is composed of pusher pins 310, a pusher pad 320, pneumatic cylinders 330, a hydraulic servo cylinder 340, a hydraulic servo valve 350, a cushion stroke sensor 360, a hydraulic unit 370 and a hydraulic servo controller 380, to provide the aforementioned functions.

The pusher pins 310 are rod-shaped structures that support the blank holder 10. The pusher pins 310 penetrate the bolster 40, support the lower surface of the blank holder 10 at the top end thereof, and are supported by the pusher pad 320 at the bottom end thereof.

The pusher pad 320 is a structural body that supports the pusher pins 310, and is disposed below the bolster 40 in a manner such that it is free to move in the up/down direction.

The pneumatic cylinders 330 are air-type RAM cylinders that support the pusher pad 320 from below, and are installed on the press bed 50. The cylinder members of the pneumatic cylinders 330 are fixed to the lower surface of the pusher pad 320, and the lower ends of the RAM piston members are supported by the press bed 50. The cylinder members engage with the RAM piston members in such a manner that they are free to move up and down. The pneumatic cylinders 330 are connected through air piping to an air source (not illustrated).

The hydraulic servo cylinder 340 is a dual-rod-type hydraulic servo cylinder which is attached to the press bed so that the rods of which can move freely in the up/down direction. The upper rod 341 is connected to the pusher pad 320.

The hydraulic servo valve 350 is a servo control valve for the hydraulic servo cylinder 340, that drives the upper rod 341 of the hydraulic servo cylinder 340 with a preferred stroke, operating force and speed under the control of the hydraulic servo controller 380.

The cushion stroke sensor 360 is a sensor for measuring the travel of the pusher pad 320, the output of which is transmitted to the hydraulic servo controller 380.

The hydraulic unit 370 is a hydraulic unit dedicated to the hydraulic servo cylinder 340, and supplies the hydraulic servo cylinder 340 with an operating fluid through the hydraulic servo valve 350.

The hydraulic servo controller 380 is a control device that actuates the hydraulic servo valve 350, and outputs control signals to the hydraulic servo valve 350 based on positional information sent from the cushion stroke sensor 360.

Next, the procedure by which the die cushion apparatus performs the required functions is described. FIG. 2 shows the movement of the die passing through points 2, 4, 3 and 5 and the movement of the blank holder passing through points 6, 7, 8 and 9. The movements of the lower surface of the die moving up and down and the upper surface of the blank holder moving up and down are shown with elapsed time on the abscissa.

The movement curve of the die is similar to that of a sine wave, although it may differ depending on the mechanism of the press machine. The top and bottom of the movement curve are called top dead center point 2 and bottom dead center point 3, respectively.

When the die is located at the top dead center point 2, the blank holder 10 remains stationary at an intermediate predetermined point 6 between the top dead center point 2 and the bottom dead center point 3.

The die 20 moves down from the top dead center point 2 along the movement curve 4, and reaches the bottom dead center point 3 while pressing the blank against the punch 30. The blank holder 10 is pushed down by the die 20 and moves to the bottom dead center point 3. Meanwhile, the outer periphery of the blank is clamped between the upper surface 11 of the blank holder 10 and the lower surface 21 of the die 20, and is pressed with a predetermined force produced by the pneumatic cylinders 330. The force prevents the outer periphery of the blank from being creased. Also, since the die cushion apparatus 1 presses the die 20 upwards with a predetermined clamping force created by the pneumatic cylinders 330, the noise and vibration that would otherwise be produced between the upper and lower molds during the pressing process is reduced.

When the die 20 passes the bottom dead center point 3 and moves along the rising curve 5, the hydraulic servo controller 380 detects information sent from the cushion stroke sensor 360 about the travel of the pusher pad 320, controls the hydraulic servo cylinder 340 via the hydraulic servo valve 350, and stops the pusher pad 320 by opposing the force from the pneumatic cylinders 330. In addition, the hydraulic servo cylinder 340 lowers the pusher pad 320 by a predetermined distance (for instance, about 3 mm). Consequently, the blank holder 10, with the blank, resting on it, is prevented from moving upwards at the bottom dead center point 3, and is moved further down from the bottom dead center point by a predetermined distance (for example, about 3 mm) to the lower position 8.

When the die rises from the bottom dead center point 3 towards the top dead center point 2, the hydraulic servo cylinder 340 raises the pusher pad 320 by a predetermined distance (for instance, about 35 mm) to position 9, and stops the pad thereof. The blank holder 10 on which the blank is resting stops at the position 9 at a predetermined elevation (for example, about 35 mm). An unloader receives the blank resting on the blank holder, and sends it to a subsequent process.

When the die 20 reaches the top dead center point 2, the hydraulic servo cylinder 340 lifts the pusher pad 320 to the initial standby position 6. The blank holder 10 remains at the intermediate predetermined position 6 between the top dead center point 2 and the bottom dead center point 3, and the condition has returned to the initial status of the cycle. Subsequently, this cycle is repeated and pressing work is carried out.

In the case of the aforementioned die cushion apparatus, because a hydraulic servo cylinder is used to control the position of the pusher pad, the apparatus has the advantage that the movement can be freely chosen to provide the preferred positions, however on the other hand, there are disadvantages caused by the use of the hydraulic servo cylinder.

First, the hydraulic servo system must use an operating fluid which is cleaner than that of conventional hydraulic devices. If the cleanliness of the oil becomes even slightly reduced, a servo-lock phenomenon seen only in hydraulic servo devices occurs, causing the hydraulic servo cylinder to stop. Therefore, the cleanliness of the operating fluid should be maintained at a specified high level, so controlling the cleanliness of the operating fluid is a considerable burden.

Secondly, since the hydraulic servo valve controls the hydraulic servo cylinder, there is a time delay in the response of the servo system. The hydraulic servo controller sends a control signal to the hydraulic servo valve at a predetermined timing taking the delay into consideration. Work to set the timing must be done very precisely, and sometimes, the position of the sensor must be readjusted. If the pressing speed is changed or the dies are changed, the control system must be readjusted.

Consequently, the die cushion apparatus using a conventional hydraulic servo system is expensive and is difficult to handle and maintain, which is a practical problem.

SUMMARY OF THE INVENTION

The present invention aims at solving the above-mentioned problems, and provides a die cushion apparatus that is less expensive and can be easily handled and maintained, compared to a conventional die cushion apparatus.

To achieve the object described above, the die cushion apparatus according to the present invention that can hold the periphery of a blank during the process of pressing the blank using dies, is provided with a support member that can hold the blank, gas pressure cylinders that push up the support member, a hydraulic cylinder of which the upper rod is connected to the support member, a pneumo-hydraulic converter for secondary lifting with a piston that partitions the interior of the converter into an oil chamber that communicates with the oil chamber of the hydraulic cylinder on the side of the aforementioned rod and a gas chamber, a check valve that allows oil to flow from the oil chamber on the side opposite to the above-mentioned rod to the oil chamber on the side of the aforementioned rod, and a drain port that communicates with the oil chamber on the side of the aforementioned rod of the hydraulic cylinder; when the die passes the bottom dead center point, the drain port is closed, and when the die is moving up from the bottom dead center point to the top dead center point, the pressure in the gas chamber of the pneumo-hydraulic converter for secondary lifting is reduced and the piston is driven to the gas chamber side.

According to the above-mentioned configuration of the present invention, the support member supports the blank from below, the gas pressure cylinders push the support member upwards, the upper rod of the hydraulic cylinder is connected to the support member, and the above-mentioned rod, support member and blank are pushed upwards as a single unit by the gas pressure cylinders.

The check valve prevents oil from flowing from the oil chamber on the aforementioned rod side to the oil chamber at the opposite end, closes the drain port communicating with the oil chamber on the above-mentioned rod side of the hydraulic cylinder, and can confine oil in the oil chamber on the aforementioned rod side of the hydraulic cylinder.

The pneumo-hydraulic converter for secondary lifting is provided with a piston that partitions the interior into an oil chamber communicating with the oil chamber on the above-mentioned rod side of the hydraulic cylinder and a gas chamber, oil from the oil chamber on the above-mentioned rod side of the hydraulic cylinder can be transferred into the oil chamber of the pneumo-hydraulic converter for secondary lifting, by moving the piston towards the gas chamber.

Oil in the oil chamber on the aforementioned rod side of the hydraulic cylinder can be confined by closing the drain port when the die passes the bottom dead center point.

The operating fluid in the oil chamber on the above-mentioned rod side of the hydraulic cylinder can be transferred into the oil chamber of the pneumo-hydraulic converter for secondary lifting by decreasing the pressure in the gas chamber of the pneumo-hydraulic converter for secondary lifting and allowing the piston to move towards the gas chamber side during the process of moving the die from bottom dead center to top dead center.

In addition, die cushion apparatus according to the present invention is provided with a pneumo-hydraulic converter for locking, with a piston that partitions the interior into an oil chamber communicating with the oil chamber on the aforementioned rod side of the hydraulic cylinder and a gas chamber; when the die passes the bottom dead center point, the pressure in the gas chamber of the pneumo-hydraulic converter for locking is increased and the piston is moved towards the oil chamber side.

According to the above-mentioned configuration of the present invention, the pneumo-hydraulic converter for locking is provided with a piston that partitions the interior into the oil chamber communicating with the oil chamber on the above-mentioned rod side of the hydraulic cylinder and the gas chamber; by moving the piston towards the oil chamber side, the operating fluid can be transferred into the oil chamber on the aforementioned rod side of the hydraulic cylinder while the die is passing through the bottom dead center point. As the piston is moved towards the oil chamber side by increasing the pressure in the gas chamber of the pneumo-hydraulic converter for locking, the operating fluid in the oil chamber of the locking pneumo-hydraulic converter can be transferred into the oil chamber on the above-mentioned rod side of the hydraulic cylinder.

In the die cushion apparatus according to the present invention, the above-mentioned drain port is a hole that penetrates the wall of the oil chamber of the pneumo-hydraulic converter for locking, the piston of the pneumo-hydraulic converter for locking closes the drain port when it is moved to the oil chamber side, and the piston of the pneumo-hydraulic converter for locking opens the drain port, when it is moved to the gas chamber side.

Using the aforementioned configuration of the present invention, oil in the oil chamber of the above-mentioned rod side of the hydraulic cylinder can be drained through a hole that penetrates the wall of the oil chamber in the pneumo-hydraulic converter for locking. When the piston of the pneumo-hydraulic converter for locking is moved to the oil chamber side, the piston of the pneumo-hydraulic converter for locking closes the aforementioned drain port. Once the piston of the pneumo-hydraulic converter for locking is moved to the gas chamber side, the piston of the pneumo-hydraulic converter for locking opens the drain port.

In addition, the die cushion apparatus according to the present invention is devised such that the pneumo-hydraulic converter for locking is located in the piston of the pneumo-hydraulic converter for secondary lifting.

According to the aforementioned configuration of the present invention, the pneumo-hydraulic converter for locking is installed in the piston of the pneumo-hydraulic converter for secondary lifting, and the pneumo-hydraulic converter for locking can be integrated into a single body with the pneumo-hydraulic converter for secondary lifting.

Moreover, the die cushion apparatus of the present invention is configured in such a manner that the aforementioned drain port always communicates with the hole that penetrates the wall of the pneumo-hydraulic converter for secondary lifting.

By virtue of the above-mentioned configuration of the present invention, the aforementioned drain port can always communicate with the hole penetrating the wall of the pneumo-hydraulic converter for secondary lifting, and oil in the oil chamber on the above-mentioned rod side of the hydraulic cylinder can be drained through the hole penetrating the wall of the oil chamber in the pneumo-hydraulic converter for locking and the hole that penetrates the wall of the pneumo-hydraulic converter for secondary lifting.

Furthermore, the die cushion apparatus according to the present invention is composed such that the pneumo-hydraulic converter for secondary lifting is built into the cylinder of the pneumo-hydraulic converter for locking. The above-mentioned configuration of the present invention enables the pneumo-hydraulic converter for secondary lifting to be installed in the cylinder of the pneumo-hydraulic converter for locking and the pneumo-converters for secondary lifting and locking can be integrated into a single body.

In addition, the die cushion apparatus based on the present invention incorporates pneumo-hydraulic converters consisting of pneumo-hydraulic-based intensifiers.

In the configuration mentioned above according to the present invention, the pneumo-hydraulic converters can be driven by a low-pressure gas because the pneumo-hydraulic converters are pneumo-hydraulic-based intensifiers.

Other objects and advantages of the present invention can be revealed by the following descriptions referring to the attached drawings.

DETAILED DESCRIPTION OF PREFERRED EMBODIMENTS

Figure 1:
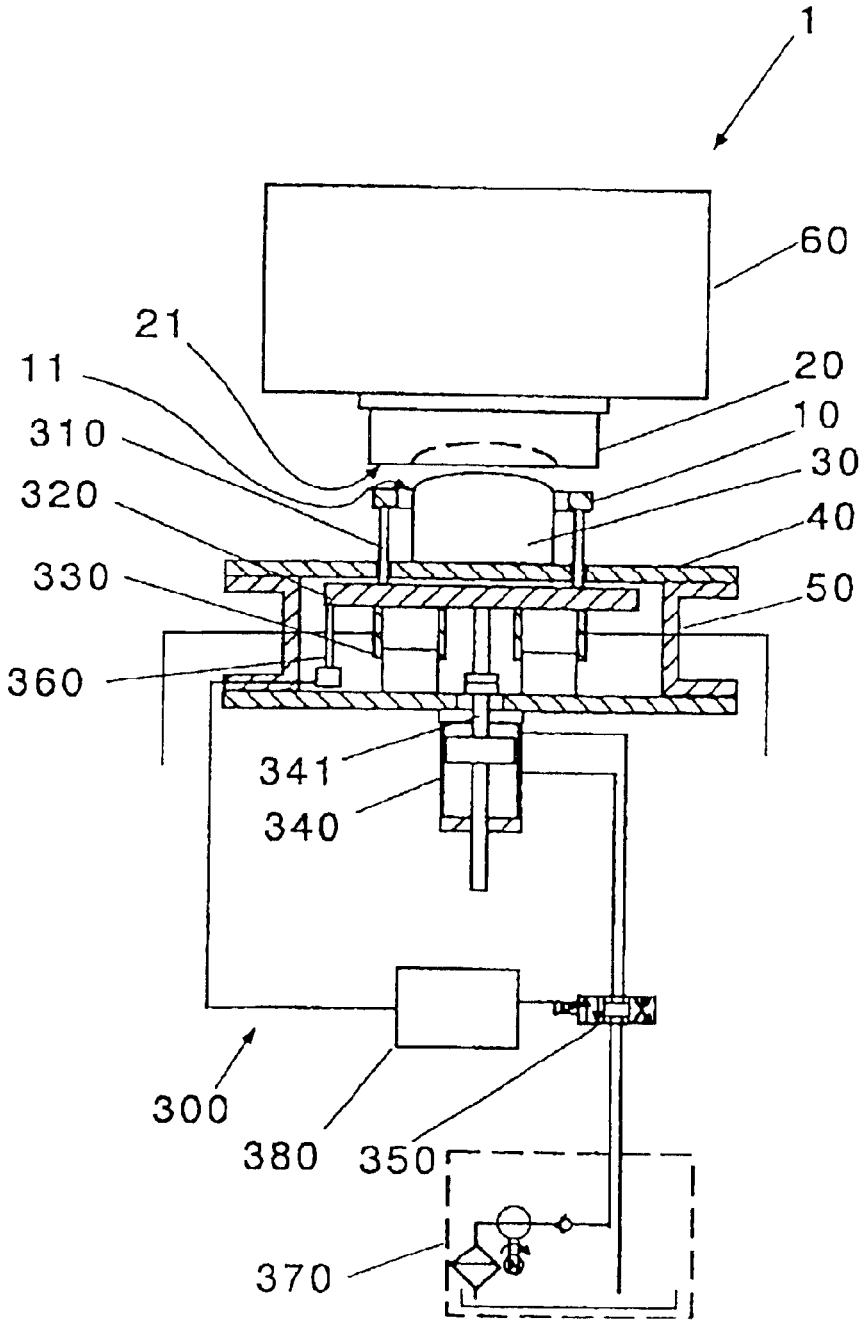
Fig.1 Prior Art
FIG. 1 shows the side view of a conventional apparatus.
Figure 2:
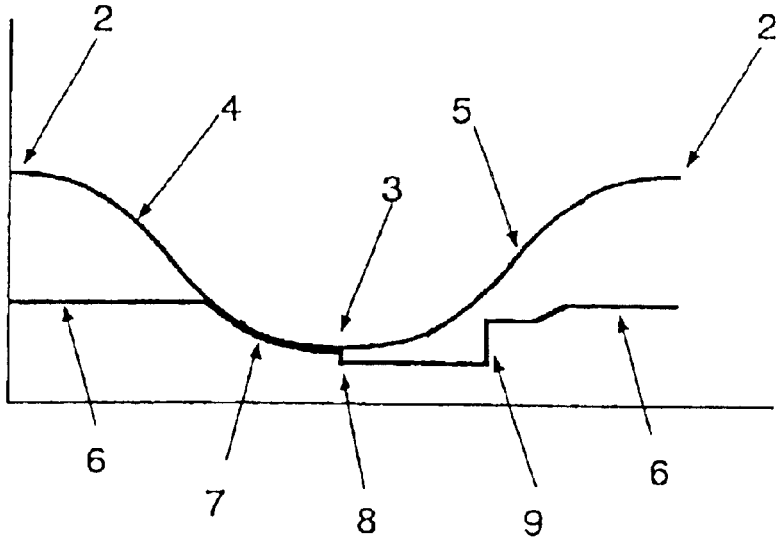
Fig.2 Prior Art
FIG. 2 shows the movement paths of the die and the blank holder.

The first embodiment of the present invention is described as follows referring to the drawings. In each drawing, common parts are identified with the same numbers, and no duplicate description is given.

Figure 3:
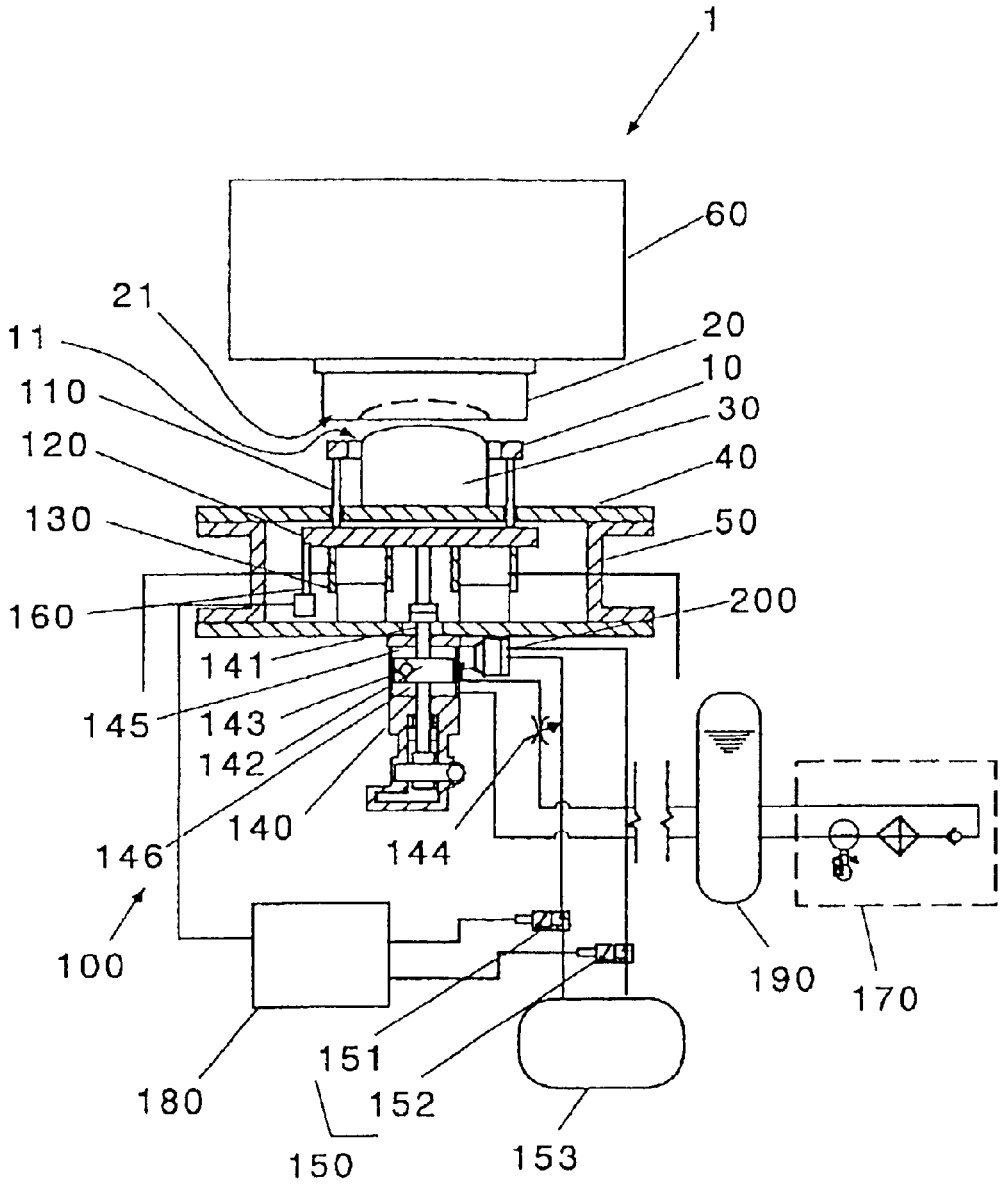
FIG. 3 is a side view of an embodiment of the present invention.
Figure 4:
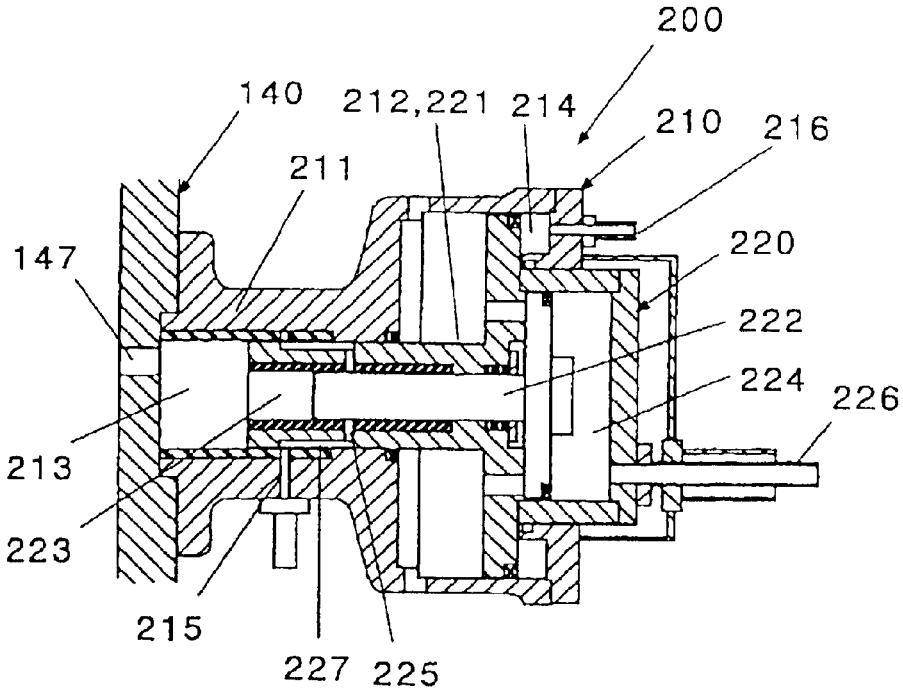
FIG. 4 is a sectional view of part of an embodiment of the present invention.
Figure 5:
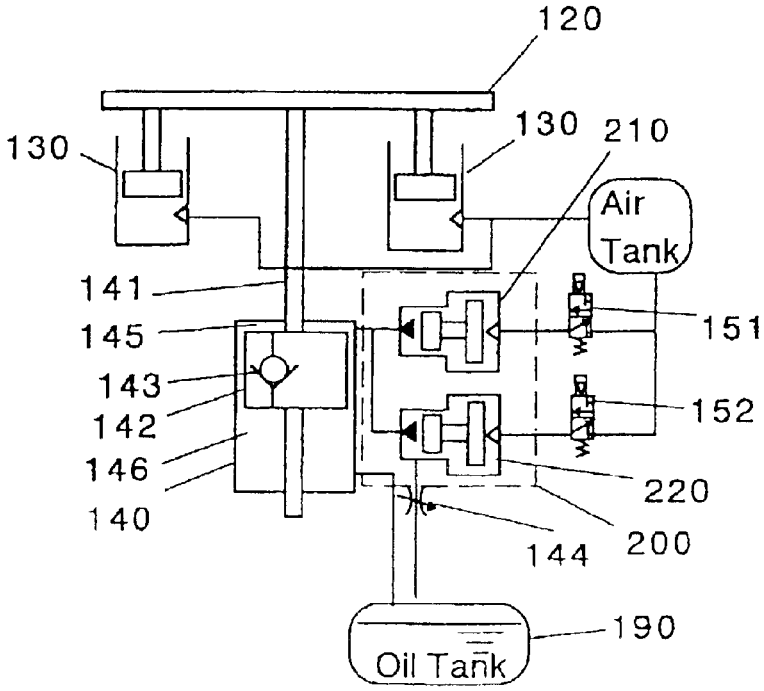
FIG. 5 shows a hydraulic system diagram of the embodiment of the present invention.
Figure 6:
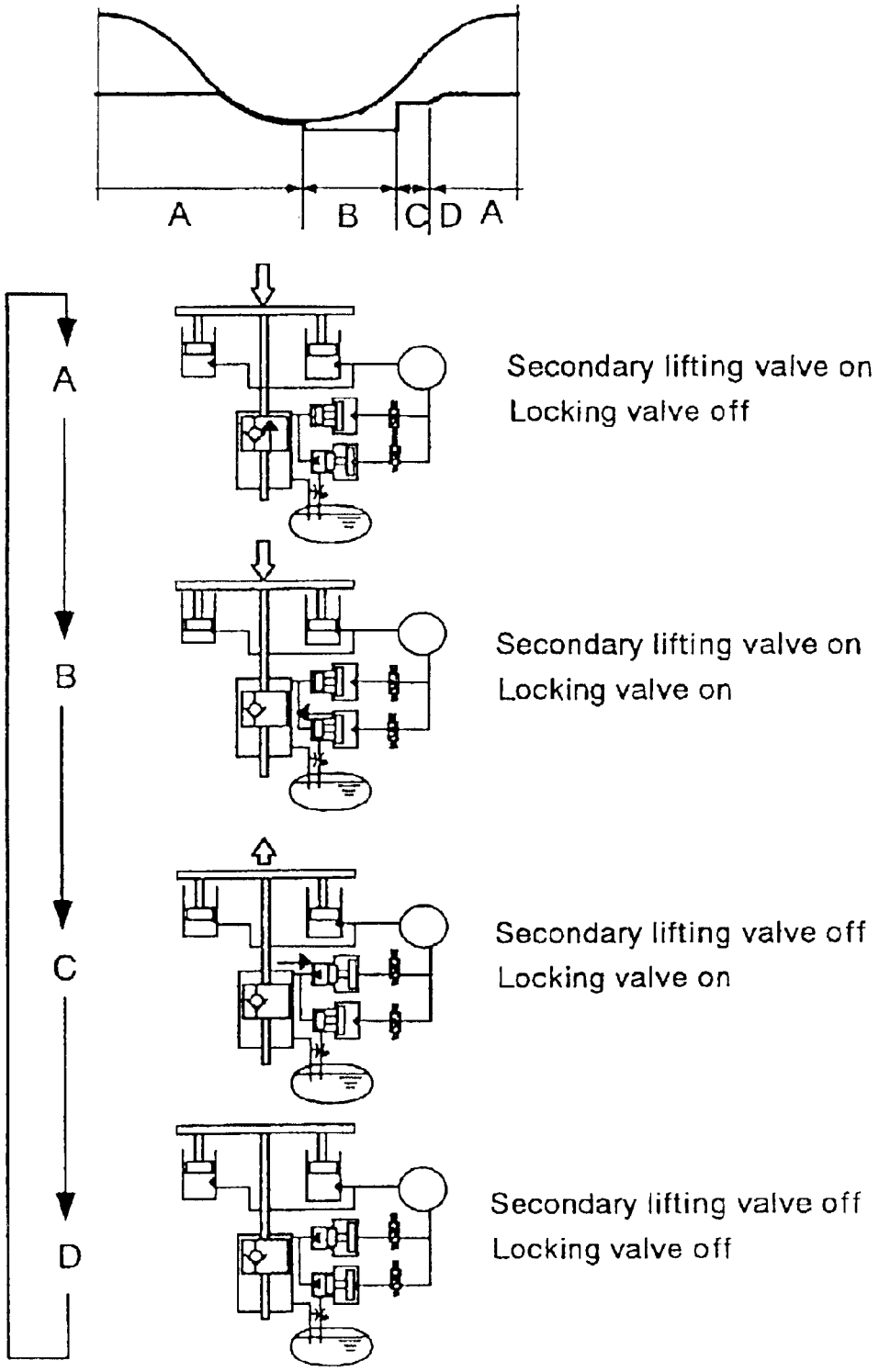
FIG. 6 is a diagram describing the operation of the embodiment of the present invention.
Figure 7:
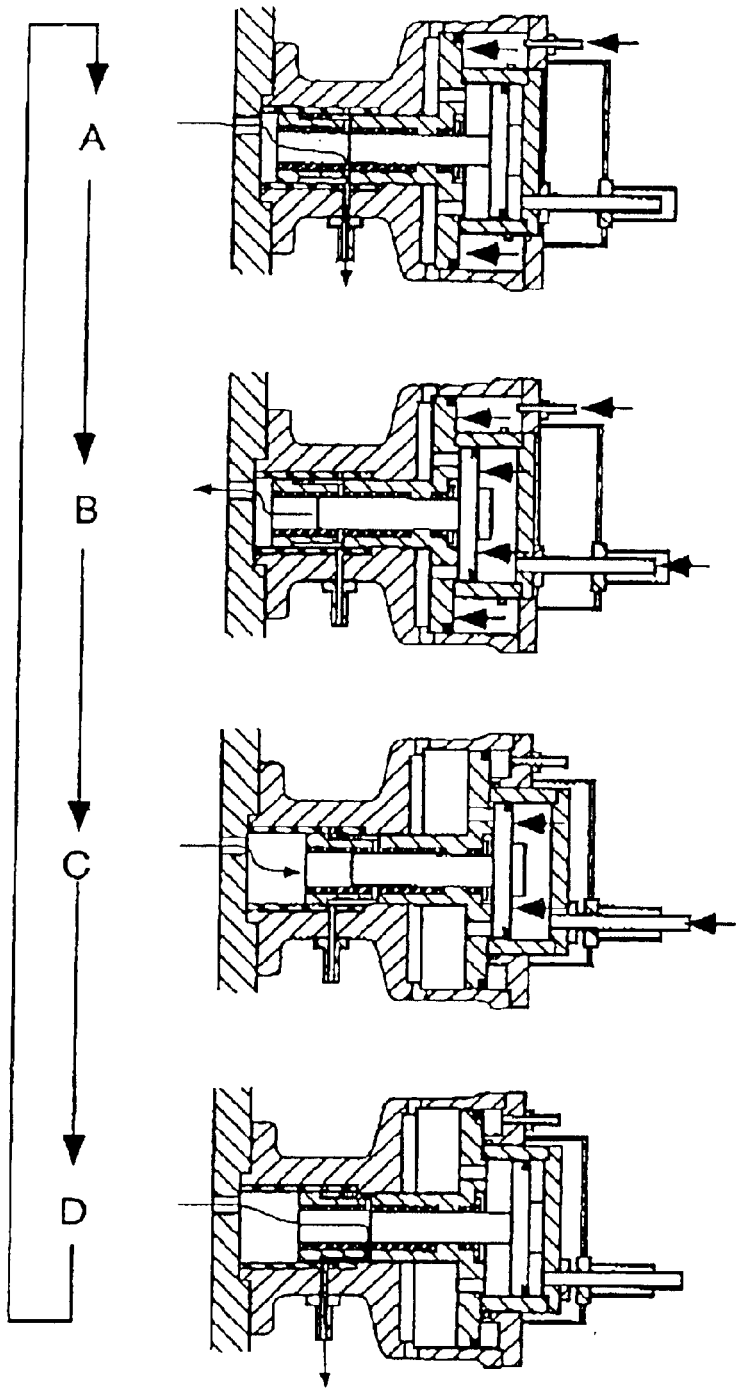
FIG. 7 is a diagram illustrating part of the operation of the embodiment according to the present invention.

The construction of the die cushion apparatus according to the first embodiment of the present invention is described. FIG. 3 is a sectional view of the first embodiment according to the present invention. FIG. 4 is a view showing a section of part of the embodiment of the invention. FIG. 5 shows a hydraulic system diagram of the embodiment. FIG. 6 is a diagram describing the operations of the embodiment according to the present invention. FIG. 7 is a diagram describing the operations of part of the embodiment of the invention.

The construction of the die cushion apparatus according to the embodiment of the present invention is described below. The cushion apparatus 100 is composed of pusher pins 110, a pusher pad 120 (acting as a supporting structure), pneumatic cylinders 130, a hydraulic cylinder 140, changeover valves 150, a cushion stroke sensor 160, a hydraulic unit 170, a controller 180, an oil pressure tank 190, and an operating cylinder 200.

The construction of the pusher pins 110, pusher pad 120 and pneumatic cylinders 130 is identical to that of a conventional die cushion apparatus, therefore, no further description is given here.

The hydraulic cylinder 140 is a dual-rod-type ordinary hydraulic cylinder, and is installed on a press bed so that the rod can move up and down freely. The upper rod is connected to the pressure pad. For the convenience of description, the oil chamber on the side of the upper rod is called the upper oil chamber 145, and the oil chamber on the opposite side, the lower oil chamber 146. The check valve 143 is provided in the hydraulic cylinder piston 142 of the hydraulic cylinder 140. The check valve 143 allows oil to flow from the lower oil chamber 146 to the upper oil chamber 145, and stops flow in the reverse direction thereto.

The changeover valve 150 is a 3-port electromagnetic changeover valve, equipped with a secondary lifting changeover valve 151 and a locking changeover valve 152. Each valve 151 or 152 connects an air source to the equipment when energized, and vents air in the equipment to atmosphere when power is cut off.

The cushion stroke sensor 160 measures the travel of the pusher pad 120, the output of which is transmitted to the controller 180. The hydraulic unit 170 is a hydraulic unit for the hydraulic cylinder, and supplies pressurized fluid to the oil pressure tank. The controller 180 controls the changeover valve 150 in response to signals sent from the cushion stroke sensor 160. The oil pressure tank 190 is a tank for storing operating fluid sent from the hydraulic unit 170. The oil pressure tank 190 communicates with the lower oil chamber 146 of the hydraulic cylinder 140 through hydraulic piping, and further communicates with the operating cylinder 200 through hydraulic piping and a flow regulator valve 144. The operating cylinder 200 communicates with the upper oil chamber 145 of the hydraulic cylinder 140.

Next, the construction of the operating cylinder 200 is described. The operating cylinder 200 is provided with a pneumo-hydraulic converter 210 for secondary lifting and a pneumo-hydraulic converter 220 for locking; the pneumo-hydraulic converter 220 for locking is installed in the piston 212 for secondary lifting of the pneumo-hydraulic converter 210 for secondary lifting. In certain embodiments of the invention, one or both of the pneumo-hydraulic converter 210 for secondary lifting and the pneumo-hydraulic converter 220 for locking consist of a pneumo-hydraulic-based intensifier.

The pneumo-hydraulic converter 210 for secondary lifting is comprised of a cylinder 211 for secondary lifting, piston 212 for secondary lifting and an air feed pipe 216 for secondary lifting. The cylinder 211 for secondary lifting is provided with an oil chamber 213 for secondary lifting and an air chamber 214 for secondary lifting. The oil chamber 213 for secondary lifting and the air chamber 214 for secondary lifting are cylindrical spaces with different diameters, aligned on the same axis as the axis of the cylinder 211 for secondary lifting. The end of the cylindrical space on the oil chamber side is open, and the end thereof on the air chamber side is closed. The diameter of the oil chamber 213 for secondary lifting is smaller than the diameter of the air chamber 214 for secondary lifting. The air feed pipe 216 communicates with the air chamber 214 for secondary lifting.

The piston 212 for secondary lifting is composed of an oil-chamber piston with a diameter slightly smaller than the diameter of the oil chamber 213 for secondary lifting and an air-chamber piston with a diameter slightly smaller than the diameter of the air chamber 214 for secondary lifting, arranged on the same axis. In addition, the piston 212 is provided with a cylindrical compartment filled with air, on the air-chamber side.

In addition, the drain port 215 for secondary lifting is provided on the wall of the oil chamber 213 for secondary lifting. The drain port 215 for secondary lifting is located in such a position that even when the piston 212 for secondary lifting travels over the entire stroke, the port is covered by the piston 212 for secondary lifting and is closed thereby.

The pneumo-hydraulic converter 220 for locking is provided with a cylinder 221 for locking and a piston 222 for locking. The outer surface of the cylinder 221 for locking also functions as the piston 212 for secondary lifting. Thus the pneumo-hydraulic converter 220 for locking and the pneumo-hydraulic converter 210 for secondary lifting are coaxially arranged as shown in FIG. 4.

An oil chamber 223 for locking and an air chamber 224 for locking are provided around the cylinder 221 for locking. The oil chamber 223 for locking and the air chamber 224 for locking are cylindrical spaces with different diameters, aligned on the same axis as the axis of the cylinder 221 for locking. The end of the cylindrical space on the oil chamber side is open to the oil chamber 213 for secondary lifting, and the end thereof on the air chamber side is closed. The diameter of the oil chamber 223 for locking is smaller than the diameter of the air chamber 224 for locking. The air feed pipe 226 communicates with the air chamber 224 for locking.

The piston 222 for locking is structured in such a manner that an oil-chamber piston with a diameter slightly less than the diameter of the oil chamber 223 for locking is connected to an air-chamber piston with a diameter slightly smaller than the diameter of the air chamber 224 for locking, on the same axis.

In addition, a drain port 225 for locking is located on the wall of the oil chamber 223 for locking. The drain port 225 for locking becomes open to the oil chamber for locking when the piston 222 for locking moves all the way to the side of the air chamber 224 for locking; when the piston 222 for locking moves all the way to the side of the oil chamber 223 for locking, the port is closed as it is covered by the piston 222 for locking. Besides, a passage way that communicates from the drain port 225 for locking to the drain port 215 for secondary lifting is formed in the outer surface of the piston 222 for locking.

Next, the operation of the die cushion apparatus is described referring to the drawings. FIG. 5 is a hydro-pneumatic system diagram of the die cushion apparatus. For easy understanding, the pneumo-hydraulic converter 210 for secondary lifting and the pneumo-hydraulic converter 220 for locking are shown separately. FIGS. 6 and 7 show the status at each stage of the processes.

First, the die is located at the top dead center point, and the blank holder is in a standby position at an intermediate predetermined location between the top and bottom dead center points.

(Process A) The changeover valve 151 for secondary lifting is energized, and the changeover valve 152 for locking is deenergized. The piston 212 for secondary lifting in the pneumo-hydraulic converter 210 for secondary lifting travels to the side of the oil chamber 213 for secondary lifting, so the volume of the space at the oil chamber 213 for secondary lifting side is a minimum. The piston 222 for locking in the pneumo-hydraulic converter 220 for locking travels to the air chamber 224 for locking side, so the volume of the oil chamber 223 for locking is a maximum. The hydraulic cylinder piston 142 of the hydraulic cylinder 140 rises.

The die 10 descends from the top dead center point along the movement path and reaches the bottom dead center point with presses the blank against the punch 30. The blank holder 10 is lowered to the bottom dead center point as it is pressed by the die 20. The blank holder 10 presses the upper rod 141 downwards through the pusher pins 110 and the pusher pad 120. The piston 142 of the hydraulic cylinder 140 is pushed downwards by the upper rod 141. Operating fluid in the lower oil chamber 146 passes into the upper oil chamber 145 through the check valve 143.

At that time, the outer periphery of the blank is clamped between the upper surfaces of the blank holder and lower surface of die, and is pressed vertically with a predetermined force produced by the pneumatic cylinders, so the outer periphery of the blank is prevented from being creased. Also, since the die cushion apparatus pushes the die upwards with a predetermined force created by the pneumatic cylinders, noise and vibration that might otherwise be produced by the upper and lower dies during the pressing process are reduced.

(Process B) When the die 20 passes the bottom dead center point and starts to rise, the controller 180 inputs a signal detecting the movement of the pusher pad 120 sent from the cushion stroke sensor 160, and at the same time energizes the changeover valve 152 for locking. The air pressure in the air chamber 224 for locking of the penumo-hydraulic converter 220 for locking is increased, and the piston 222 for locking moves to the side of oil chamber 223 for locking The piston 222 for locking closes the drain port 225 for locking. Operating fluid in the upper oil chamber 145 of the hydraulic piston 222 is trapped in place. When the piston 222 for locking moves to the side of the oil chamber for locking, operating fluid in the oil chamber 223 for locking flows into the upper oil chamber 145 through the penetration 147 of the hydraulic cylinder 140. Because the volume of operating fluid in the upper oil chamber 145 is increased, the hydraulic cylinder piston 142 of the hydraulic cylinder 140 is pushed down. The amount by which it is pulled down is given by the quotient of the volume of operating fluid entering from the oil chamber 223 for locking into the upper oil chamber 145, divided by the effective sectional area of the upper oil chamber 145 (for instance, about 3 mm). Therefore, the blank holder 10 that carries the blank is locked and prevented from moving above the bottom dead center point, and is then lowered by a predetermined dimension from the bottom dead center point (for example, about 3 mm).

(Process C) When the die rises from the bottom dead center point to the top dead center point, the controller 180 detects the stroke signal from the pusher pad 120, sent from the cushion stroke sensor 160, and deenergizes the changeover valve 151 for secondary lifting. The air pressure in the air chamber 214 for secondary lifting in the pneumo-hydraulic converter 210 for secondary lifting decreases, and the piston 212 for secondary lifting moves to the side of the air chamber 214 for secondary lifting. When the piston 212 for secondary lifting has moved to the side of the air chamber 214 for secondary lifting, operating fluid in the upper oil chamber 145 flows into the oil chamber for secondary lifting through the hydraulic cylinder penetration 147 of the hydraulic cylinder 140. Since the volume of the operating fluid in the upper oil chamber 145 decreases, the hydraulic cylinder piston 142 of the hydraulic cylinder 140 rises. The stroke of the rise thereof is given by the quotient calculated by dividing the volume of the operating fluid entering into the oil chamber 213 for secondary lifting from the upper oil chamber 145 by the effective cross section of the upper oil chamber 145 (for instance, about 35 mm). Consequently, the blank holder 10 that supports the blank is raised by a predetermined dimension (for example, about 35 mm) and then stops. The unloader receives the blank supported by the blank holder 10, and sends it to a subsequent process.

(Process D) Before the die reaches the top dead center point, the controller 180 inputs a signal detecting the movement of the pusher pad 120 sent from the cushion stroke sensor 160, and deenergizes the changeover valve 152 for locking. The air pressure in the air chamber 224 for locking of the pneumo-hydraulic converter 220 for locking is reduced, and the piston 222 for locking moves to the side of the air chamber 224 for locking. In addition, the piston 222 for locking opens the drain port 225 for locking that has been closed. When the piston 222 for locking moves to the side of the air chamber 224 for locking, the operating fluid in the upper oil chamber 145 passes through the hydraulic cylinder penetration 147 of the wall of the hydraulic cylinder 140, flows into the oil chamber for locking, passes through the drain port 225 for locking and is discharged outside. The speed at which the operating fluid flows out of the drain port 225 for locking is adjusted to a predetermined speed by the flow regulator valve 144. Therefore, the hydraulic cylinder piston 142 of the hydraulic cylinder 140 rises at a predetermined speed, and raises the pusher pad to the initial standby position. The blank holder 10 remains stationary at an intermediate location between the top and bottom dead center points. The changeover valve 151 for secondary lifting is energized, and the cycle resumes from the initial status. This cycle is repeated subsequently, to press blanks.

Using the die cushion apparatus according to the aforementioned embodiment, an ordinary operating fluid can be used, so there is no need to control the cleanliness of the fluid unlike conventional servo systems. Since a conventional 3-port solenoid changeover valve is used, the apparatus can work reliably and quickly without any of the delays in control responses that are often seen in a conventional servo system, and the apparatus can easily be adjusted. Because the pneumo-hydraulic converter is used, oil can be input and output without delay, therefore the overall timing of the die cushion apparatus can be easily adjusted. In addition, the operating cylinder can be made compact as the pneumo-hydraulic converter for secondary lifting is integrated into the pneumo-hydraulic converter for locking. In addition, because an intensifier can be used for the pneumo-hydraulic converters, so-called utility air normally available at the works can be used, so no special air source must be provided.

The present invention is not restricted only to the above-mentioned embodiments, but the invention can be modified in various ways as long as the essentials of the invention are not exceeded. Although the foregoing description referred to the pneumo-hydraulic converter for locking, being built into the piston of the pneumo-hydraulic converter for secondary lifting, the invention is not restricted only to that construction; instead, the pneumo-hydraulic converter for secondary lifting can be incorporated in the piston of the pneumo-hydraulic converter for locking, or the pneumo-hydraulic converter for locking can be structured separately from the pneumo-hydraulic converter for secondary lifting. Albeit the operating gas cylinder was described as being operated by air as the gas, this is not a restriction, and any gas can be used.

As explained above, the die cushion apparatus that can hold the periphery of a blank when it is being pressed by the die according to the present invention provides the following advantages by virtue of its configuration.

Since the aforementioned rod and supporting member, integrated together, are pushed upwards by the gas pressure cylinder, the blank can be pushed upwards when the die is being lowered. In addition, when the die passes the bottom dead center point, the drain port is closed and oil in the oil chamber on the side of the above-mentioned rod of the hydraulic cylinder is trapped in place, thus the movement of the blank can be stopped. In addition, when the die moves from the bottom dead center point to the top dead center point, the blank can be raised by a predetermined distance as the pneumo-hydraulic converter for secondary lifting moves the piston to the gas chamber side and operating fluid in the oil chamber on the side of the aforementioned rod of the hydraulic cylinder flows into the oil chamber of the pneumo-hydraulic converter for secondary lifting.

In addition, as the pneumo-hydraulic converter for locking can transfer operating fluid from the oil chamber into the oil chamber on the above-mentioned rod side of the hydraulic cylinder by moving the piston to the oil chamber side, the blank can be lowered by a predetermined distance by filling the oil chamber on the above-mentioned rod side of the hydraulic cylinder with the operating fluid in the oil chamber of the pneumo-hydraulic converter for locking when the die passes the bottom dead center point.

Since oil can be drained from the oil chamber on the aforementioned rod side of the hydraulic cylinder through the hole penetrating the cylinder wall of the oil chamber in the pneumo-hydraulic converter for locking and the flow of oil can be stopped by moving the piston of the pneumo-hydraulic converter for locking to the oil chamber side, the oil can be confined in the oil chamber on the aforementioned rod side of the hydraulic cylinder by increasing the pressure in the gas chamber of the pneumo-hydraulic converter for locking. In addition, because the piston of the pneumo-hydraulic converter for locking can open the aforementioned hole when the piston is moved to the gas chamber side, the oil can be drained from the oil chamber on the above-mentioned rod side of the hydraulic cylinder by decreasing the pressure in the gas chamber of the pneumo-hydraulic converter for locking.

Also, the pneumo-hydraulic converter for locking and the pneumo-hydraulic converter for secondary lifting can be integrated into one body, so these converters can be made compact.

In addition, oil can be drained from the oil chamber on the above-mentioned rod side of the hydraulic cylinder through the hole penetrating the wall of the oil chamber in the pneumo-hydraulic converter for locking and the hole through the wall of the pneumo-hydraulic converter for secondary lifting, therefore the drain port can be incorporated into the integrated assembly of the pneumo-hydraulic converters for locking and secondary lifting.

In addition, the pneumo-hydraulic converters for secondary lifting and locking can be consolidated into a single unit, so these converters can be made compact.

Since the pneumo-hydraulic converters can be driven by a low-pressure gas, the die cushion apparatus can be driven by an easily procured gas.

In consequence, a die cushion apparatus that is low in cost and easy to handle and maintain can be offered.

What is claimed is:

1. A die cushion apparatus that can hold a blank during the process of passing the blank with a die, the apparatus comprising:

a support member that can hold the blank;

a gas pressure cylinder that pushes the support member upwards;

a hydraulic cylinder having an upper rod connected to the support member;

a first pneumo-hydraulic converter for secondary lifting, the first converter comprising a first cylinder and a secondary lifting piston, wherein the lifting piston partitions an interior of the first cylinder into a first oil chamber and a first gas chamber, the first oil chamber communicating with a second oil chamber at an upper rod side of the hydraulic cylinder;

a check valve that allows oil to flow from a third oil chamber of the hydraulic cylinder at a side opposite the rod to the second oil chamber of the hydraulic cylinder;

a drain port that communicates with the second oil chamber on the side of the upper rod of the hydraulic cylinder, whereby when the die passes a bottom dead center point, the drain port is closed, and while the die is traveling from the bottom dead center point to a top dead center point, pressure in the first gas chamber of the first pneumo-hydraulic converter for secondary lifting is reduced, thus moving the secondary lifting piston to a side of the first gas chamber; and a second pneumo-hydraulic converter for locking with a locking piston that partitions an interior of the second converter into a fourth oil chamber and a second gas chamber, the fourth oil chamber communicating with the second oil chamber on the side of the upper rod of the hydraulic cylinder, whereby when the die passes the bottom dead center point, an output is sent from a cushion stroke sensor causing pressure in the second gas chamber of the second pneumo-hydraulic converter for locking to be increased, thus the locking piston is moved to a side of the fourth oil chamber of the second pneumo-hydraulic converter for locking.

2. The die cushion apparatus specified in claim 1, wherein said drain port is a hole that penetrates the wall of the fourth oil chamber of the second pneumo-hydraulic converter for locking, wherein said drain port is closed when the locking piston of the second pneumo-hydraulic converter for locking is moved to the fourth oil chamber side, and said drain port is opened when the locking piston of the second pneumo-hydraulic converter for locking is moved to the second gas chamber side.

3. The die cushion apparatus specified in claim 1, wherein the second pneumo-hydraulic converter for locking is installed in the lifting piston of the first pneumo-hydraulic converter for secondary lifting.

4. The die cushion apparatus specified in claim 3, wherein said drain port communicates with the hole that penetrates the wall of the first pneumo-hydraulic converter for secondary lifting, at all times.

5. The die cushion apparatus specified in claim 1, wherein the second pneumo-hydraulic converter includes a second cylinder, wherein the second pneumo-hydraulic converter is installed in the first cylinder of the first pneumo-hydraulic converter.

6. The die cushion apparatus specified in claim 1, wherein the first pneumo-hydraulic converter for secondary lifting is an air-hydraulic intensifier.

7. The die cushion apparatus specified in claim 2, wherein the second pneumo-hydraulic converter for locking is installed in the lifting piston of the first pneumo-hydraulic converter for secondary lifting.

8. The die cushion apparatus specified in claim 2, wherein the second pneumo-hydraulic converter is installed in the first cylinder of the first pneumo-hydraulic converter for locking.

9. The die cushion apparatus specified in claim 1, wherein one or both of the first pneumo-hydraulic converter for secondary lifting and the second pneumo-hydraulic converter for locking is an air-hydraulic intensifier.

10. The die cushion apparatus specified in claim 2, wherein one or both of the first pneumo-hydraulic converter for secondary lifting and the second pneumo-hydraulic converter for locking is an air-hydraulic intensifier.

11. The die cushion apparatus specified in claim 3, wherein one or both of the first pneumo-hydraulic converter for secondary lifting and the second pneumo-hydraulic converter for locking is an air-hydraulic intensifier.

12. The die cushion apparatus specified in claim 4, wherein one or both of the first pneumo-hydraulic converter for secondary lifting and the second pneumo-hydraulic converter for locking is an air-hydraulic intensifier.

13. The die cushion apparatus specified in claim 5, wherein one or both of the first pneumo-hydraulic converter for secondary lifting and the second pneumo-hydraulic converter for locking is an air-hydraulic intensifier.

14. The die cushion apparatus specified in claim 7, wherein one or both of the first pneumo-hydraulic converter for secondary lifting and the second pneumo-hydraulic converter for locking is an air-hydraulic intensifier.

15. The die cushion apparatus specified in claim 8, wherein one or both of the first pneumo-hydraulic converter for secondary lifting and the second pneumo-hydraulic converter for locking is an air-hydraulic intensifier.

16. The die cushion apparatus specified in claim 1, wherein a controller is operably connected to receive the signal from the cushion stroke sensor, and the controller is operably connected to send a control signal to an electromagnetic changeover valve, wherein when the controller receives a signal from the cushion stroke sensor, the controller sends a control signal to operate the electromagnetic changeover valve to effect the increase in pressure in the second gas chamber.

17. A die cushion apparatus that can hold a blank during the process of passing the blank with a die, the apparatus comprising:

a support member for holding the blank;

a gas pressure cylinder disposed to push the support member upwards;

a hydraulic cylinder having an upper rod connected to the support member;

a first pneumo-hydraulic converter for secondary lifting, the first converter comprising a first cylinder and a lifting piston, wherein the lifting piston partitions an interior of the first cylinder into a first oil chamber and a first gas chamber, the first oil chamber communicating with a second oil chamber at an upper rod side of the hydraulic cylinder;

a check valve disposed to allow oil to flow from a third oil chamber of the hydraulic cylinder at a side opposite the rod to the second oil chamber of the hydraulic cylinder;

a drain port communicating with the second oil chamber on the side of the upper rod of the hydraulic cylinder, whereby when the die passes a bottom dead center point, the drain port is closed, and while the die is traveling from the bottom dead center point to a top dead center point, pressure in the first gas chamber is reduced, thus moving the lifting piston to a side of the first gas chamber; and a second pneumo-hydraulic converter for locking having a locking piston that partitions an interior of the second converter into a fourth oil chamber and a second gas chamber, the fourth oil chamber communicating with the second oil chamber on the side of the upper rod of the hydraulic cylinder, whereby when the die passes the bottom dead center point, an output is sent from a cushion stroke sensor causing pressure in the second gas chamber to be increased, thus moving the locking piston to a side of the fourth oil chamber of the second pneumo-hydraulic converter.

18. The die cushion apparatus specified in claim 17, wherein said drain port is a hole penetrating the wall of the fourth oil chamber of the second pneumo-hydraulic converter, wherein said drain port is closed when the locking piston of the second pneumo-hydraulic converter is moved toward the fourth oil chamber, and said drain port is opened when the locking piston of the second pneumo-hydraulic converter is moved toward the second gas chamber.

19. The die cushion apparatus specified in claim 18, wherein one or both of the first pneumo-hydraulic converter and the second pneumo-hydraulic converter is an air-hydraulic intensifier.

20. The die cushion apparatus specified in claim 17, wherein the second pneumo-hydraulic converter further comprises a second cylinder associated with the locking piston, and the second cylinder is installed so an outer surface of the second cylinder forms the lifting piston of the first pneumo-hydraulic converter.

21. The die cushion apparatus specified in claim 17, wherein the first pneumo-hydraulic converter and the second pneumo-hydraulic converter are coaxially arranged.

22. The die cushion apparatus specified in claim 17, wherein the second pneumo-hydraulic converter further comprises a second cylinder associated with the locking piston, wherein the second pneumo-hydraulic converter is installed in the first cylinder of the first pneumo-hydraulic converter.

* * * * *